US005306055A

United States Patent [19]

Mainetti

[11] Patent Number: 5,306,055

[45] Date of Patent: Apr. 26, 1994

[54] PLASTIC SEAL

[75] Inventor: Mario Mainetti, Castelgomberto, Italy

[73] Assignee: Mainetti S.p.A., Castelgomberto, Italy

[21] Appl. No.: 848,002

[22] PCT Filed: Oct. 11, 1990

[86] PCT No.: PCT/EP90/01705

§ 371 Date: Apr. 20, 1992

§ 102(e) Date: Apr. 20, 1992

[87] PCT Pub. No.: WO91/06084

PCT Pub. Date: May 2, 1991

[51] Int. Cl.[5] ..... B65D 33/34

[52] U.S. Cl. ..... 292/320

[58] Field of Search ..... 292/307, 308, 310, 311, 292/312, 313, 317, 318, 319, 320, 321, 326; 264/251, 157

[56] References Cited

U.S. PATENT DOCUMENTS

| | | | |
|---|---|---|---|
| 529,318 | 11/1894 | Brooks | 292/313 |
| 570,127 | 10/1896 | Gogle | 292/320 |
| 2,345,767 | 4/1944 | Moberg | 292/308 |
| 4,106,802 | 8/1978 | Lozio | 292/320 |
| 4,636,347 | 1/1987 | Kato | 264/251 |
| 4,887,855 | 12/1989 | Tritton et al. | 292/307 R |

FOREIGN PATENT DOCUMENTS

| | | | |
|---|---|---|---|
| 343532 | 6/1978 | Austria . | |
| 654517 | 6/1963 | Italy | 292/317 |
| 660127 | 1/1964 | Italy | 292/317 |
| 1594207 | 7/1981 | United Kingdom | 292/320 |
| 2115354A | 9/1983 | United Kingdom . | |

*Primary Examiner*—Richard E. Moore

*Attorney, Agent, or Firm*—Stewart L. Gitler

[57] ABSTRACT

A plastic seal including: a body to which is connected at least one cord, provided with at least one end with a hook; an aperture provided in the body for insertion of the hook; a seat for housing the hook inserted into the aperture; a means for the irreversible retention of the hook to the body and a pair of closure plates applied to the body.

24 Claims, 2 Drawing Sheets

FIG.5
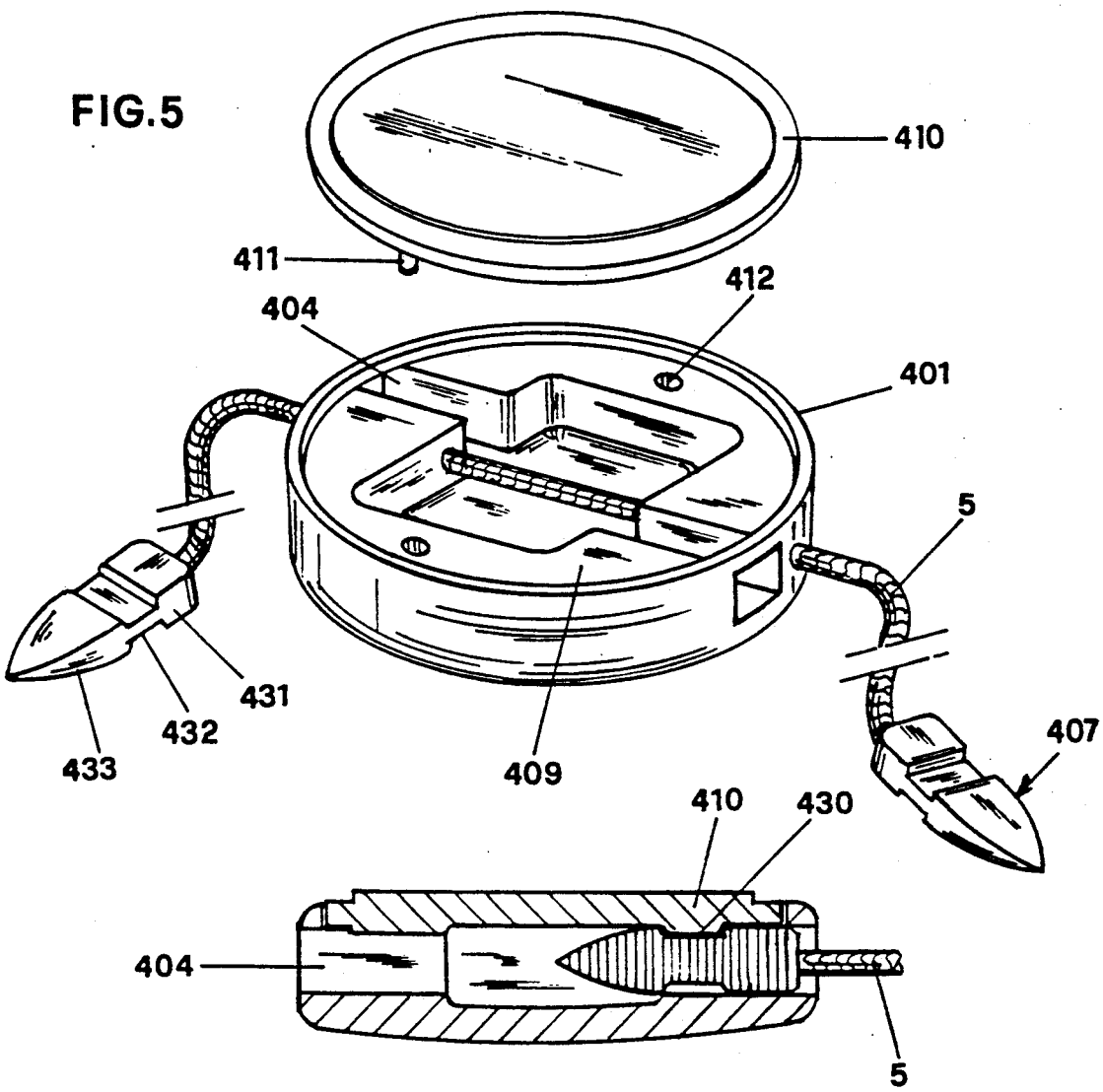
FIG.6
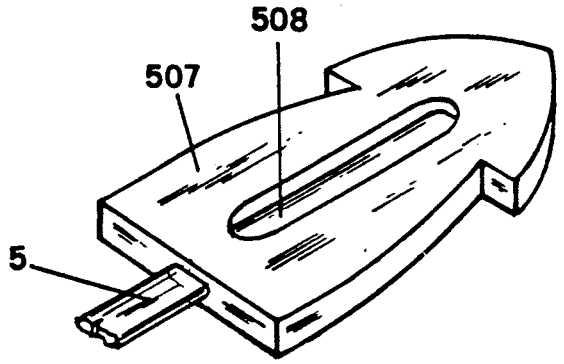
FIG.7

PLASTIC SEAL

This invention relates to a plastic seal arrangement.

Plastic seals are widely known in practically all sectors of commercial activity, and comprises a body generally designed to receive distinctive marks or signs of the producer or seller, or other identification data for the product to be marked, such as an article number, a size, a colour code etc. Said seals also comprise one or two cords fixed securely at one end to said body and provided at their other end with a hook for non-removable insertion into a corresponding cavity provided in said body, after the cord has been passed through an aperture (eyelet, chain link, hole etc) provided in the article to be marked.

Such seals have in the past been constructed and are still constructed with a very large variety of shapes, dimensions and body-chord fixing systems. They are generally formed by injecting plastics material into moulds comprising several impressions corresponding to the complete shape of the seal body or to the shape of each of the half-bodies of which each body is formed. It is apparent that the number of different impressions available must equal the number of different types of seal body to be formed combined with the number of different designs or writing to appear on each body, which means that a seal manufacturer must carry considerable and expensive equipment which in certain cases may be under-used, resulting in a high unit seal cost.

In addition, the operations required for fixing the cord to the body of current seals are difficult to mechanize, thus further increasing the final cost of the article, a cost which for obvious reasons must be as low as possible. In this respect, taking account of the lenghty time needed to set up the injection press and the consequent overall cost of this operation, the production cost of each seal can only be kept low by producing large quantities, thus obliging users to carry large and uneconomical stocks.

A further drawback consists in that generally such seals, after they have been formed, are grouped in bunches or in confusion and this causes an entanglement of the cords or a linking of hooks, with consequent loss of time for the required separation.

EP-A1 0 217 499 discloses a shackle-type seal having two portions which enclose a hollow chamber for receiving a pair of shackle legs engaging with means provided within the chamber.

AT-A 343 532 discloses a plastic seal which comprises a closed box having a side parture for the snap insertion of a body provided with a seal in which a hook engages.

US-A-4 636 347 discloses a plastic seal comprising a string and a plurality of male members and female members fused to said string.

An object of the invention is to provide a plastic seal arrangement which is of simple and economical production.

A further object of the invention is to provide a plastic seal arrangement which can be produced with completely automated equipment.

A further object of the invention is to provide a plastic seal arrangement which does not have to be carried in large stock by the user.

A further object of the invention is to provide a plastic seal arrangement having a very pleasing outer appearance and which enables this outer appearance to be varied according to the requirements of the user.

These and further objects which will be apparent from the following description are attained according to the invention by a plastic seal arrangement as described in claim Some preferred embodiments of the present invention are further described hereinafter with reference to the accompanying drawings in which:

FIG. 5 shows a fifth embodiment thereof in the same view as FIG. 1,

FIG. 6 shows it along the transversal section of FIG. 5; and

FIG. 7 shows the hook in a different embodiment.

Figure 1:
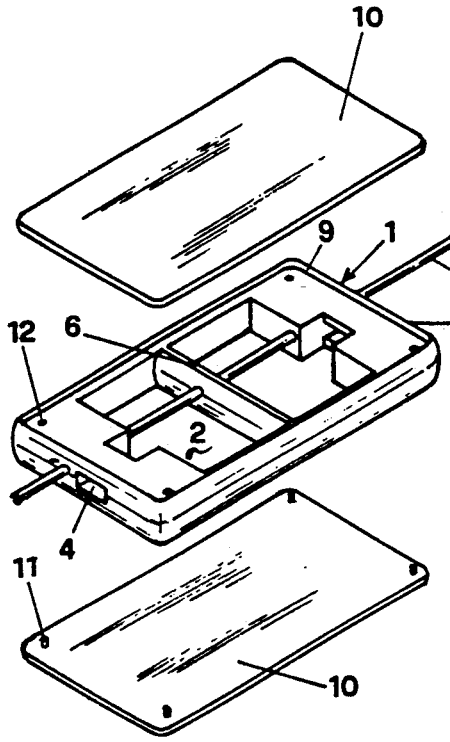
FIG. 1 is an exploded perspective view of a first embodiment of a seal according to the invention with two cords provided with a hook.

As can be seen from the figures the seal of the invention, in the embodiment shown in FIG. 1, comprises a perimetral frame 1 of rectangular shape constructed of thermoplastic material such as polystyrene and comprising two inner cavities 2.

The two smaller sides 3 of the frame 1 each comprise a through aperture 4, which connects the outside to the corresponding cavity 2.

In the plastics material forming the frame 1 there is embedded a cord 5 which passes through the two smaller sides 3 thereof in proximity to the through apertures 4, and also passes through the baffle 6 which divides the internal space of the frame 1 into two cavities 2. To the ends of the cord 5 there are applied two hooks 7 provided with elastic retention tongues 8 for irreversible insertion into the through apertures 4.

The perimetral edge of the frame 1 comprises steps 9 which defines on both faces a seat for a rectangular plate 10 carrying printed on its outer surface a mark or writing identifying the type or characteristics of the article to which the seal is to be applied. The plates 10, which preferably have a thickness equal to the height of the step 9, can be constructed of plastics material or aluminium or cardboard, and can be decorated either by printing or by a silk-screen process or by any other traditional method.

The plates 10 can be fixed to the frame 1 by adhesives, by ultrasonic welding, by an insertion fit, or by engaging appendices 11 provided on the plates 10 with corresponding seats 12 provided in the frame 1. The fixing system obviously depends on the constituent material of the plate; for example in the case of metal plates it is preferable for this fixing to be by either adhesive or by a simple insertion fit if the dimension of the seat for the plate are such as to receive the plate as an exact fit, or rather by slight forcing. In the case of cardboard plates the fixing must be done by adhesive. In the case of plastics plates the fixing can be done either by adhesives, by ultrasonic welding or by an insertion fit. In such cases the fixing efficiency can be improved by the presence of the appendices 11 and the complementary seats 12 and/or by virtue of a particular shaping of the edge of the plates 10 and the edge of the step 9, which instead of being perfectly perpendicular to the surface of the plate 10 are slightly inclined to forms a sort of dovetail joint, which it is possible to make if instead of being constructed of polystyrene the frame 1 is constructed of a material having a certain elasticity, for example a polypropylene.

To construct the seal according to the invention, a cord 5 is arranged in a mould comprising the frame impression and the impressions of two adjacent hooks facing each other with their end so that it lies across said impressions. The mould is then closed and plastics material injected into the closed cavity formed in this manner.

The mould construction is such that when closed, on those two sides of the impression corresponding to the two smaller sides of the frame 1 to be formed there are two metal pins which when the mould is closed pass through the impression, and there are also two pairs of punches which form the internal cavities 2 and which during the injection stage keep the traversing cord 5 pressed down. On termination of the injection stage the mould is opened and the cord 5, with the frame 1 and the hooks 7, is made to advance along the mould for a distance substantially corresponding to the length of the cord in condition of assembled seal, and is wound on a reel.

The mould is then closed for a new injection stage and this operation goes on until a reel is obtained completely wound by a continuous cord to which are bound, at constant intervals, frames and facing hooks.

The plates 10 are formed separately and can then be subjected to traditional decoration processes so that when thus finished they can be applied to the frame and be securely fixed to it by one of the aforesaid methods.

This application of the plates 10 to the frame 1, which can be either manual or automatic, is preferably done by the producer, but can also be done by the user, who need thus only provide himself with a reel with the frames bound to the continuous cord, a certain quantity of identical frames 1 and various different types of plates 10, with which he can personalize said frames according to requirements.

To apply the seal to the product to be marked, firstly the continuous cord is cut near the facing ends of two adjacent hooks, then the hooks are inserted through apertures of the product and lastly the hooks are inserted into the apertures of the body to be firmly secured to it.

Figure 2:
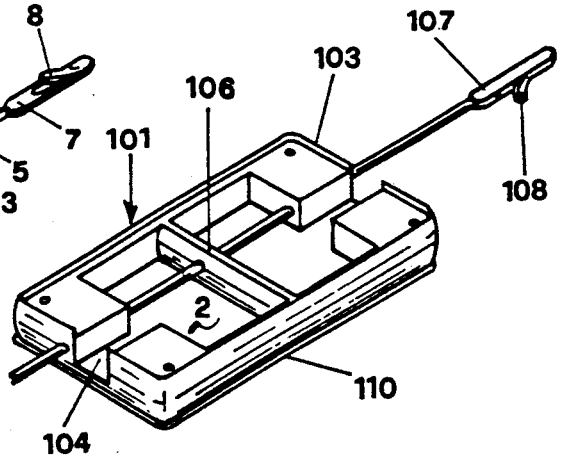
FIG. 2 is a perspective view of a second embodiment thereof without the upper plate.

In a different embodiment, shown in FIG. 2, the aperture 104 in the smaller sides 103 of the frame 101 for use by the hooks 107 extend as far as one or both edges of said sides 103, so as to dispense with the use of pins in forming the mould and make the mould construction much simpler. If the apertures 104 extend as far as only one edge, hooks 107 can be used having an elastic tongue 108 provided on a face, but in this case the hook 107 would have to be inserted into the corresponding aperture 104 in a particular direction, whereas to avoid this requirement hooks 107 must be used with their elastic tongue 108 provided laterally. If however the apertures 104 extend as far as both the edges of the smaller sides 103 of the frame 1, which are thus completely interrupted in their central region, the structural continuity of the frame 101 is ensured by the baffle 106 and by the plates 110, once these have been applied. In this case only hooks 107 with a lateral elastic tongue 108 can be used.

Figure 3:
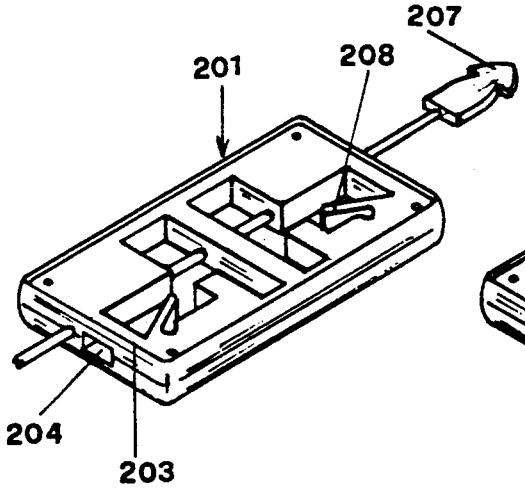
FIG. 3 shows a third embodiment thereof in the same view as FIG. 2.

In the embodiment shown in FIG. 3, the elastic tongue has been transferred from the hook 207 to the frame. For this purpose the frame 201, which obviously cannot be formed integrally with the lower plate, comprises at each aperture 204 to be engaged by the hook 207 an appendix 208 which allows the elastic engagement of a notch provided in the hook. In this manner the hook 207 can be made without projecting parts, which can sometimes become entangled in articles of clothing and damage them.

Again in this case the apertures 204 in the smaller sides 203 of the frame 201 can be of closed, semi-open or open type, so considerably simplifying the mould construction by eliminating the pins. In this embodiment the insertion position of the hook 207 is reversible irrespective of the type of aperture provided.

Figure 4:
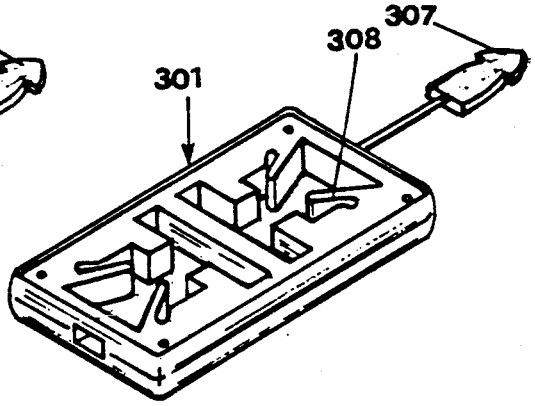
FIG. 4 shows a fourth embodiment thereof in the same view as FIG. 2.

In the embodiment shown in FIG. 4 the frame 301 is provided with two elastic tongues 308 which provide a more effective engagement with the notches of the notches in the hook 307.

In the embodiment shown in FIG. 5, the seal comprises a cylindric-shaped half-shell 401 having the pheripheral edge provided with two apertures 404. In this embodiment the bond between the plates 410 and half-shell 401 is obtained through engagment of pins 411 with corresponding seats 412, placed along an axis substantially orthogonal to the axis of the apertures 404, and provided in the half-shell 401 near the step 409.

The inner surface of the plate 410 is provided with two little protrusions 430 FIG. 6 placed on a diametral plane perpendicular to the diametral plane passing through pins 411.

Each hook 407 consist of a parallelepipedic portion 431 connected, through a thin portion 432, to a point 433.

When each hook 407 is inserted in the apertures 404, it interferes with the corresponding protrusion 430 and cause the elastic yielding outside of the plate 410 which in that zone is not bound to the half-shell 401, and which, after the passage of the hook, comes back to its initial condition thus irreversibly blocking it.

Independently of the particular embodiment the seal according to the invention has numerous advantages over traditional seals, in that:

- from an aesthetic viewpoint it is of considerably more pleasant appearance because of the very large variety of possible colour combinations,
- it can be constructed within completely automated production cycles and thus with high production rates and low production costs,
- it enables both production and stock management to be simplified in that it provides for the construction of a standard frame, to be personalized by applying particular types of selected plates,
- it enables the user to vary the aesthetic effect of the seal by holding a suitable stock of components;
- it doesn't damage, in the case of plastics hooks, the product to which is applied.

In FIG. 7 a hook 507 is shown having the middle portion provided with a slotted hole 508 in which the end of the core 5 is embedded.

Due to the presence of the hole and to the consequent transverse yielding of the hook, this can be inserted through the apertures 4 into the inner seat 2 of the seal and after it has been passed through it to extend.

This embodiment of the hook is particularly advantageous when applied to seals made of stiff plastics.

I claim:

1. A plastic seal arrangement comprising:

- a continuous flexible cord,

- a plurality of bodies passed through by said continuous flexible cord from one side to the opposite side, and equally spaced along it,
- a plurality of hooks connected to said cord, each hook being insertable, after cutting of the cord and separation of the arrangement in individual seals, into a corresponding aperture provided in said body,
- a seat for housing said hook inserted into said aperture,
- means for the irreversible retention of each hook to said aperture, and
- a pair of closure plates applied to said body.

2. An arrangement as claimed in claim 1, characterised in that each closure plate is fixed to the corresponding body with adhesive.

3. An arrangement as claimed in claim 1, characterised in that each closure plate is fixed to the body by ultrasonic welding.

4. An arrangement as claimed in claim 1 characterised in that the perimetral edge of each body comprises a step defining a seat for the corresponding closure plate.

5. An arrangement as claimed in claim 1, characterised in that at least a closure plate of each body is provided with appendices to engage in corresponding seats of said body.

6. An arrangement as claimed in claim 1, characterised in that one of the two plates of each body is formed integrally with said body.

7. An arrangement as claimed in claim 1, characterised in that the aperture provided in each body consists of a slotted hole provided in the smaller side of said body.

8. An arrangement as claimed in claim 7, characterised in that the aperture provided in each body extends to reach an edge of the smaller side of said body.

9. An arrangement as claimed in claim 8, characterised in that the aperture provided in each body extends to reach both edges of the smaller side of the body, which is stiffened by a baffle.

10. An arrangement as claimed in claim 1, characterised in that each hook is provided with a frontal tongue.

11. An arrangement as claimed in claim 1, characterised in that each hook is provided with a lateral tongue.

12. An arrangement as claimed in claim 1, characterised in that each hook is constructed of plastics material.

13. An arrangement as claimed in claim 1, characterised in that each hook is of metal construction.

14. An arrangement as claimed in claim 1, characterised in that each hook comprises at least one notch cooperating with a tongue provided in the interior of the body.

15. An arrangement as claimed in claim 1, characterised in that each hook comprises at least two notches cooperating with corresponding appendices provided in the interior of the body.

16. An arrangement as claimed in claim 15 characterised in that the appendices of each body are applied to the inner surface of the corresponding closure plate.

17. An arrangement as claimed in claim 1 characterised in that the appendices of each body are placed on a diametral plane perpendicular to the diametral plane passing through the corresponding seats.

18. An arrangement as claimed in claim 1 characterised in that each hook comprises a parallelepipedic portion provided with a point and with a longitudinal slotted hole.

19. An arrangement as claimed in claim 18 characterised in that a portion of cord is embedded at the inside of the hole.

20. An arrangement as claimed in claim 19 characterised in that the parallelepipedic portion is thickened near the zone of the point.

21. An arrangement according to claim 1 characterised in that two hooks having their end closely facing each other are connected to the continuous flexible cord in each intermediate section between two adjacent bodies.

22. An arrangement according to claim 1 characterised in that a hook having its end near to a body is connected to the continuous flexible cord.

23. An arrangement as claimed in claim 5 characterised in that the appendices of each body are placed on a diametral plane perpendicular to the diametral plane passing through the corresponding seats.

24. An arrangement as claimed in claim 16 characterised in that the appendices of each body are placed on a diametral plane perpendicular to the diametral plane passing through the corresponding seats.

* * * * *